US009617770B1

(12) United States Patent
Lin

(10) Patent No.: US 9,617,770 B1
(45) Date of Patent: Apr. 11, 2017

(54) DOUBLE-HINGE DEVICE

(71) Applicant: Leohab Enterprise Co., Ltd., Taichung (TW)

(72) Inventor: Chao-Chi Lin, Taichung (TW)

(73) Assignee: Leohab Enterprise Co., Ltd., Taichung (TW)

( * ) Notice: Subject to any disclaimer, the term of this patent is extended or adjusted under 35 U.S.C. 154(b) by 0 days.

(21) Appl. No.: 15/226,962

(22) Filed: Aug. 3, 2016

(51) Int. Cl.

| | |
|---|---|
| ***E05D 11/10*** | (2006.01) |
| ***E05D 3/06*** | (2006.01) |
| ***E05D 11/08*** | (2006.01) |
| ***E05D 3/12*** | (2006.01) |
| ***E05D 11/06*** | (2006.01) |

(52) U.S. Cl.
CPC ..... *E05D 11/082* (2013.01); *E05D 3/122* (2013.01); *E05D 11/06* (2013.01); *E05D 2011/085* (2013.01)

(58) Field of Classification Search
CPC .. E05D 3/12; E05D 3/122; E05D 3/06; E05D 3/10; E05D 11/082; E05D 11/087; E05D 2011/085; G06F 1/1681; G06F 1/1616; G06F 1/1618; G06F 1/168; E05Y 2900/606; E05Y 2900/602; H04M 1/0216; H04M 1/0222; H04M 1/022; H05K 5/0226; Y10T 16/547; Y10T 16/541
See application file for complete search history.

(56) References Cited

U.S. PATENT DOCUMENTS

| | | | | |
|---|---|---|---|---|
| 8,261,412 | B1 * | 9/2012 | Lin | G06F 1/1681 16/330 |
| 9,464,471 | B1 * | 10/2016 | Chen | G06F 1/1681 |
| 2011/0271486 | A1 * | 11/2011 | Wang | G06F 1/1681 16/319 |
| 2011/0289728 | A1 * | 12/2011 | Wang | E05D 3/122 16/337 |
| 2013/0016489 | A1 * | 1/2013 | Yeh | G06F 1/1681 361/807 |
| 2013/0111704 | A1 * | 5/2013 | Mitsui | H04M 1/022 16/250 |
| 2013/0318746 | A1 * | 12/2013 | Kuramochi | G06F 1/1681 16/342 |

(Continued)

FOREIGN PATENT DOCUMENTS

TW M480843 U 6/2014

*Primary Examiner* — Chuck Mah
(74) *Attorney, Agent, or Firm* — Alan D. Kamrath; Kamrath IP Lawfirm, P.A.

(57) ABSTRACT

A first hinge includes a rotatable first shaft and a second hinge includes a rotatable second shaft. The first shaft includes first, second, and third position retainers mounted thereon. A link plate is mounted on the first and second shafts. The first position retainer is rotatably engaged with the second position retainer and the link plate. The first position retainer is rotatable relative to the second position retainer and is rotatable to a position restrained by the second position retainer and the first and second position retainers are rotatable together. The second position retainer and the link plate are rotatably engaged and include a projection selectively received in a notch. The second position retainer and the third position retainer are rotatably engaged and include a projection selectively received in a cavity. A drive system interconnects the first and second shafts and rotates the first and second shafts simultaneously.

14 Claims, 8 Drawing Sheets

(56) References Cited

U.S. PATENT DOCUMENTS

| | | | | |
|---|---|---|---|---|
| 2015/0159413 | A1* | 6/2015 | Chen | E05D 3/122 16/342 |
| 2015/0173218 | A1* | 6/2015 | Hsu | E05D 3/12 16/366 |
| 2015/0184439 | A1* | 7/2015 | Hsu | G06F 1/16 16/350 |
| 2015/0245511 | A1* | 8/2015 | Hsu | E05D 3/122 74/63 |
| 2015/0267450 | A1* | 9/2015 | Chiang | G06F 1/1681 16/354 |
| 2015/0342068 | A1* | 11/2015 | Su | G06F 1/1681 16/354 |
| 2016/0010374 | A1* | 1/2016 | Hsu | G06F 1/1681 74/414 |
| 2016/0032633 | A1* | 2/2016 | Hsu | E05D 3/122 16/368 |

* cited by examiner

DOUBLE-HINGE DEVICE

BACKGROUND OF THE INVENTION

1. Field of the Invention

The present invention relates to a double-hinge device and, particularly, to a double-hinge device including first and second hinges adapted to be releasably fixed relative to each other.

2. Description of the Related Art

TW Pat. No. M480843 shows a double-hinge device. The double-hinge device includes a first hinge being operably rotatable, a second hinge being operably rotatable, and a plurality of hinge links connecting the first hinge and the second hinge and configured for allowing one of the first and second hinges to rotate relative to another of the first and second hinges easily. Furthermore, the first and second hinges each includes a plurality of resilient members mounted thereon and configured for helping the first and second hinges to retain at a fixed relative position. However, the plurality of resilient members can not effectively prevent the first and second hinges from being rotated inadvertently.

The present invention is, therefore, intended to obviate or at least alleviate the problems encountered in the prior art.

SUMMARY OF THE INVENTION

According to the present invention, a double-hinge device includes a first hinge which is rotatable about a first axis and includes a first shaft extending along the first axis, a second hinge which is rotatable about a second axis and includes a second shaft extending along the second axis. The first shaft includes a first position retainer, a second position retainer, and a third position retainer mounted thereon. The first position retainer includes a first projection. One of the second and third position retainers includes a second projection and another of the second and third position retainers includes a cavity. The second position retainer includes a notch. A link plate is mounted on the first and second shafts. The link plate includes a second groove. One of the second position retainer and the link plate include a first groove and another of the second position retainer and the link plate includes a third projection.

The first position retainer is rotatably engaged with the second position retainer and the link plate and includes the first protrusion engaged in the first and second grooves. The first position retainer is rotatable relative to the second position retainer. The first position retainer is rotatable to a position such that the first protrusion is restrained by the second position retainer and the first and position retainers are rotatable together. The second position retainer is rotatably engaged with the link plate and the third projection is selectively received by the notch. The second position retainer is rotatably engaged with the third position retainer and the second projection is selectively received by the cavity.

The double-hinge device also includes a drive system interconnecting the first and second shafts such that the rotation of the first and second shafts is synchronized.

The third projection is received by the notch such that the first and second hinges are releasably fixed relative to each other. Furthermore, the first projection is restrained by the second position retainer and the second projection is received by the cavity when the first and second hinges are releasably fixed relative to each other.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a double-hinge device including a first hinge and a second hinge adapted to be releasably fixed relative to each other.

Other objectives, advantages, and new features of the present invention will become apparent from the following detailed description of the invention when considered in conjunction with the accompanied drawings.

DETAILED DESCRIPTION OF THE INVENTION

Figure 1:
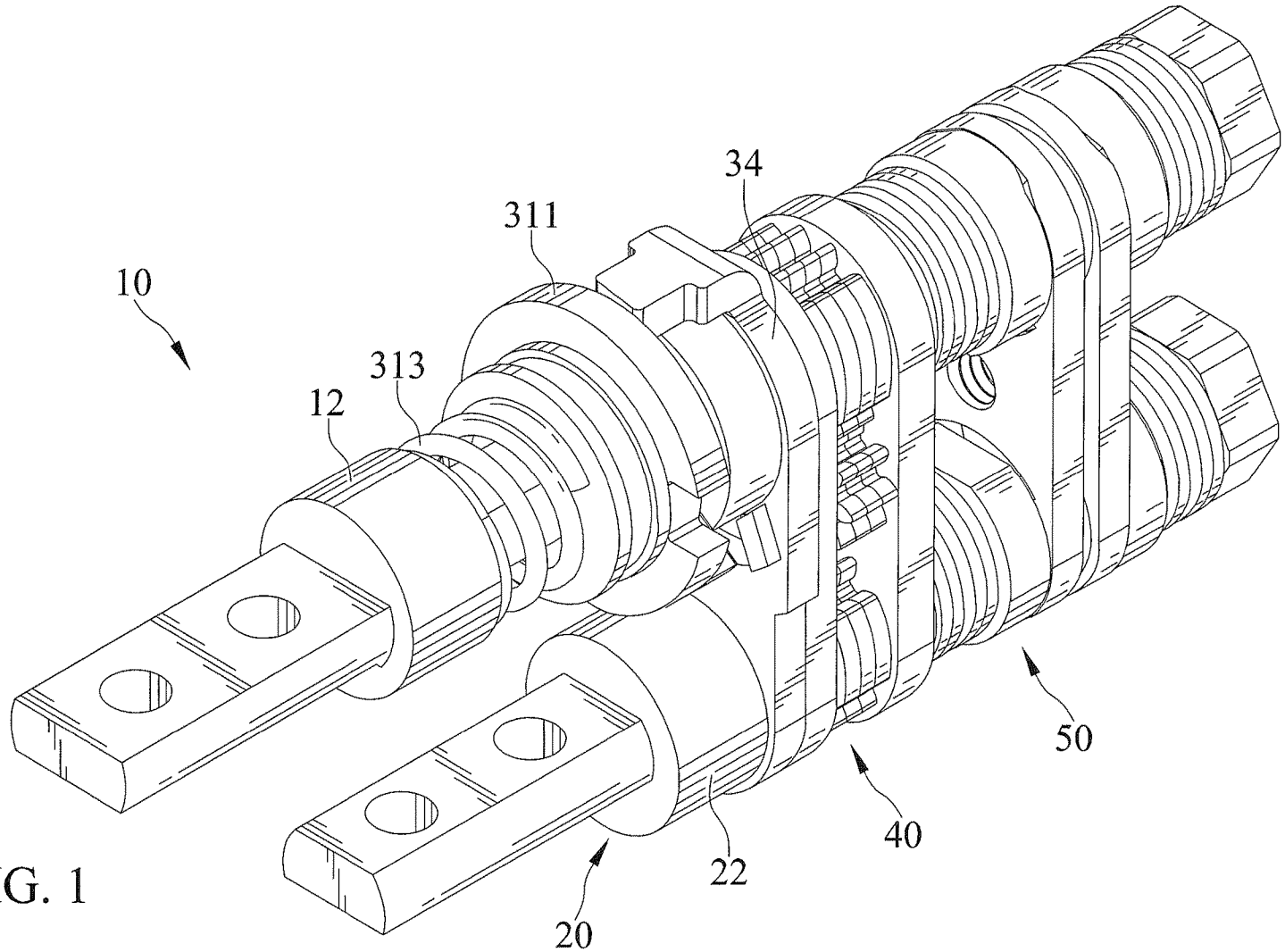
FIG. 1 is a perspective view of a double-hinge device in accordance with the present invention.
Figure 2:
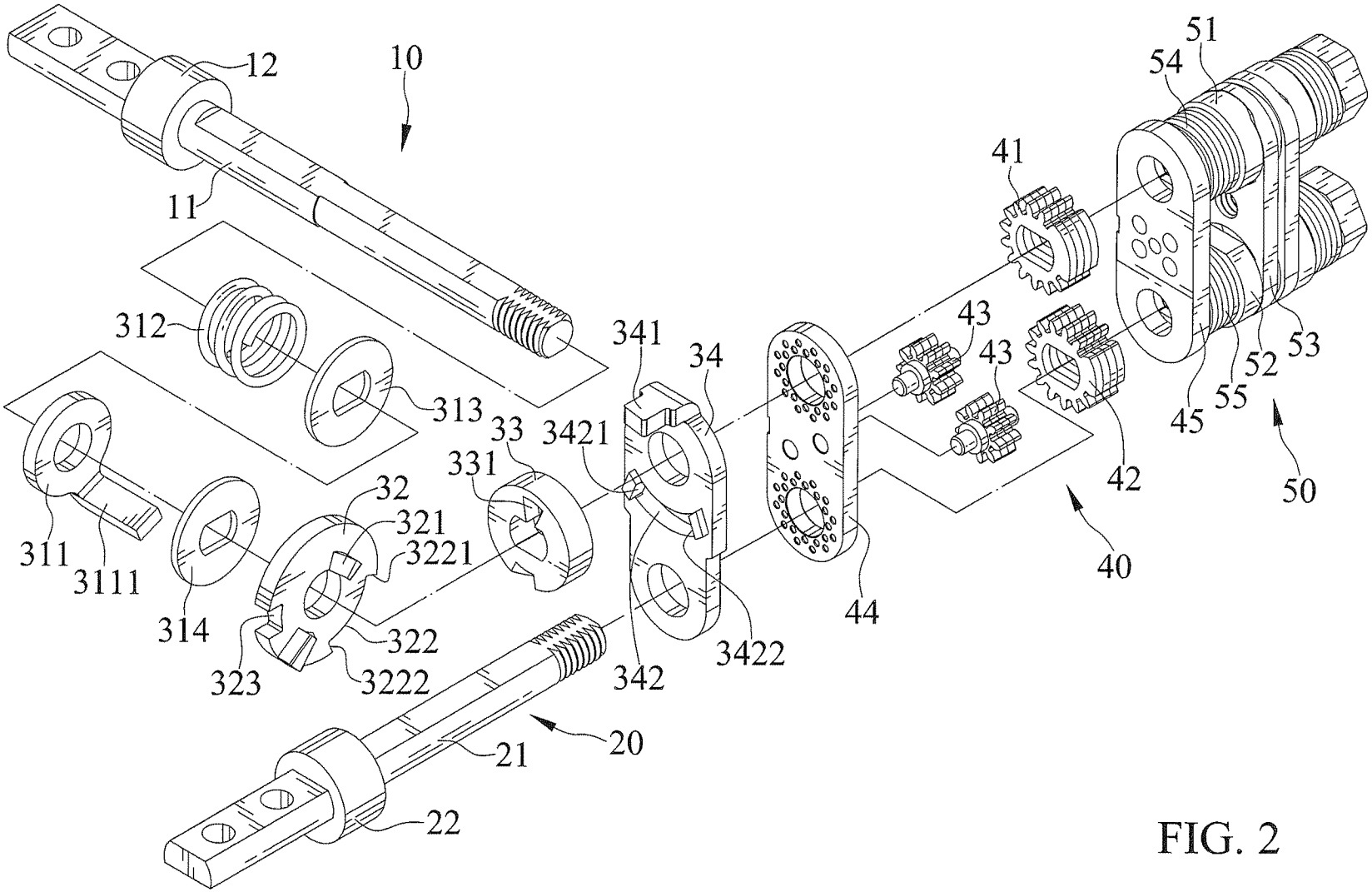
FIG. 2 is an exploded perspective view of the double-hinge device of the present invention.
Figure 3:
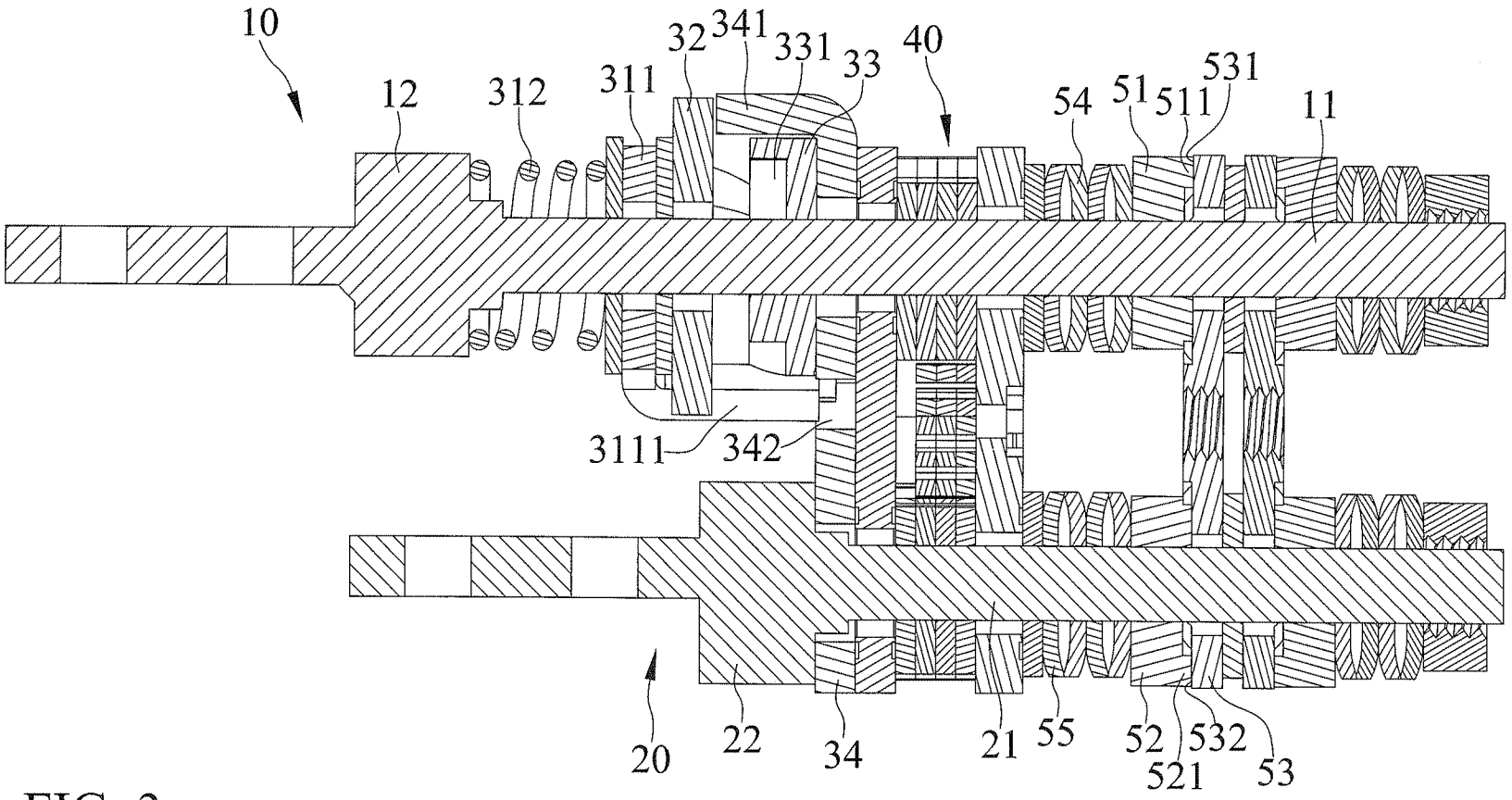
FIG. 3 is a cross-sectional view of the double-hinge device of the present invention.

FIGS. 1 through 12 show a double-hinge device in accordance with the present invention. The double-hinge device includes a first hinge 10 and a second hinge 20.

The first hinge 10 is rotatable about a first axis and including a first shaft extending along the first axis. The second hinge 20 is rotatable about a second axis and including a second shaft extending along the second axis. The first shaft includes a first section 11 configured for bearing components and a second section 12. The second section 12 has a larger diametrical size than the first section 11. The second shaft includes a first section 21 configured for bearing components and a second section 22. The second section 22 has a larger diametrical size than the first section 21.

A first position retainer 311, a second position retainer 32, and a third position retainer 33 are mounted on the first shaft. The first position retainer 311 includes a first projection 3111. One of the second and third position retainers 32 and 33 includes a second projection 321 and another of the second and third position retainers 32 and 33 includes a cavity 331. The second position retainer 32 has an annular circumferential edge. The second position retainer 32 includes a notch 323. The first groove 322 and the notch 323 are recessed on the circumferential edge of the second position retainer 32. A link plate 34 is mounted on the first and second shafts. One of the second position retainer 32 and the link plate 34 includes a first groove 322 and another of the second position retainer 32 and the link plate 34 includes a third projection 341. The first groove 322 extends in a curved path from a first distal end 3221 to a second distal end 3222. The link plate 34 includes a second groove 342. The second groove 342 extends in a curved path from a first distal end 3421 to a second distal end 3422. The third position retainer 33 is located between the second position retainer 32 and the link plate 34. A biasing member 312 is mounted on the first shaft. The first, second, and third position retainers 311, 32, and 33 and the link plate 34 are disposed on a same side of the biasing member 312. An end of the biasing member 312 is restrained by the first shaft. The biasing member 312 is a spring with a plurality of coils. The biasing member 312 is restrained by the second section of the first shaft. Washers are also mounted on the first shaft. The first position retainer 311 has two opposite sides and a first washer 313 abuts one of the two sides and a second washer 314 abuts another of the two sides.

The first position retainer 311 is rotatably engaged with the second position retainer 32 and the link plate 34. The first position retainer 311 includes the first projection 3111 engaged in the first and second grooves 322 and 342. The first position retainer 311 is rotatable relative to the second position retainer 32. The first position retainer 311 is rotatable to a position such that the first projection 3111 is restrained by the second position retainer 32 and the first and second position retainers 311 and 32 are rotatable together. The second position retainer 32 is rotatably engaged with the link plate 34 and the third projection 341 is selectively received by the notch 323. The second position retainer 32 is rotatably engaged with the third position retainer 33 and the second projection 321 is selectively received by the cavity 331. The second position retainer 32 is movable along the first shaft in response to relative positions of the second projection 321 and the cavity 331. The third projection 341 is received by the notch 323 such that the first and second hinges are releasably fixed relative to each other. The first projection 3111 is restrained by the second position retainer 32 and the second projection 321 is received by the cavity 331 when the first and second hinges 10 and 20 are releasably fixed relative to each other.

Furthermore, a drive system 40 interconnects the first and second shafts such that the rotation of the first and second shafts is synchronized. The drive system 40 includes first gear 41 mounted on the first shaft, a second gear 42 mounted on the second shaft, and two idler gears 43 inserted between the first and second gears 41 and 42. The first gear 41 rotates with the first shaft. The second gear 42 rotates with the second shaft. The first and second gears 41 and 42 and the two idler gears 43 engage with one another. First of two idler gears 43 is inserted between the first gear 41 and second of the two idler gears 43. The second of the two idler gears 43 is inserted between the first of the two idler gears 43 and the second gear 42. A support 44 is mounted on first and second shafts and the two idler gears 43 are mounted on the support 44. Thus, the support 44 supports the two idler gears 43. The support 44 has a side and includes a plurality of holes recessed in the side. The link plate 34 and the support 44 are in contact with each other and the the side of the support 44 abuts against a side of the link plate 34. The plurality of holes can receive lubricant. Another support 45 is mounted on the first and second shafts and the two idler gears 43 are mounted on the support 45. Thus, the support 45 also supports the two idler gears 43. The first and second gears 41 and 42 and the two idler gears 43 are disposed between the supports 44 and 45.

In addition, a resilient friction assembly 50 includes a first plurality of resilient friction members 54 mounted on the first shaft and a second plurality of resilient friction members 55 mounted on the second shaft respectively. A detent mechanism including a first cam 51 mounted on the first shaft and a second cam 52 mounted on the second shaft respectively. The first cam 51 defines a cam face with a first protrusion 511. The second cam 52 defines a cam face with a second protrusion 521. The first and second cams 51 and 52 are engaged with a follower 53. The first and second cams 51 and 52 are rotatably engaged with the follower 53. The follower 53 has a side and includes a first recess 531 and second recess 532 in the side. The first protrusion 511 is selectively received by the first recess 531 and the second protrusion 521 is selectively received by the second recess 532 respectively. The follower 53 is mounted on the first and second shafts. The first plurality of resilient friction members 54 are compressed in response to interaction between the first cam 51 and the follower 53. The second plurality of resilient friction members 55 are compressed in response to interaction between the second cam 52 and the follower 53.

Figure 4:
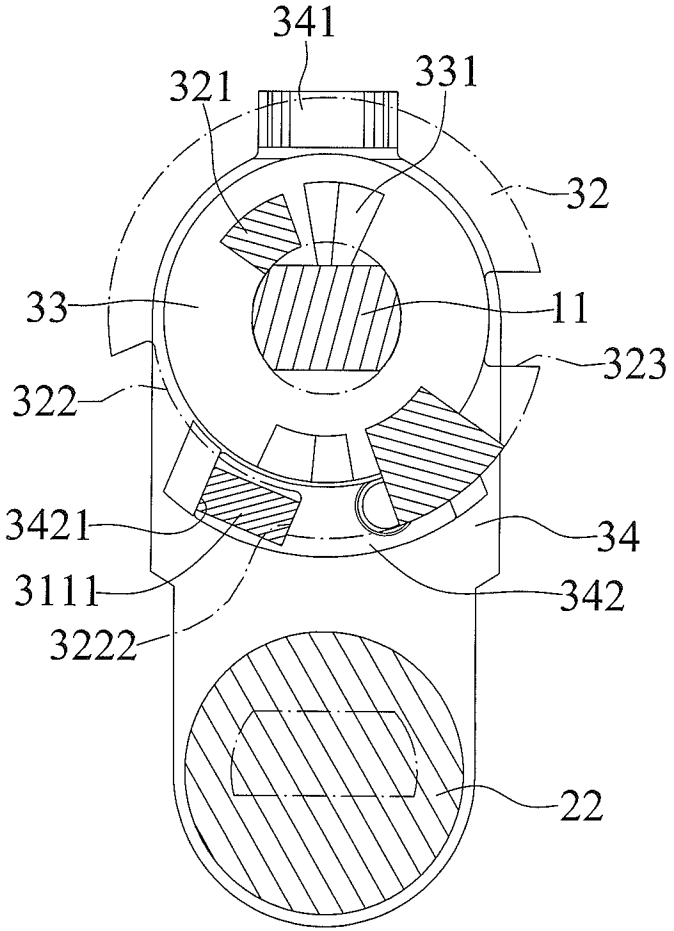
FIG. 4 is another cross-sectional view of the double-hinge device of the present invention in the position shown in FIG. 3 and shows a first hinge at 0 degrees and a second hinge at 0 degrees.
Figure 5:
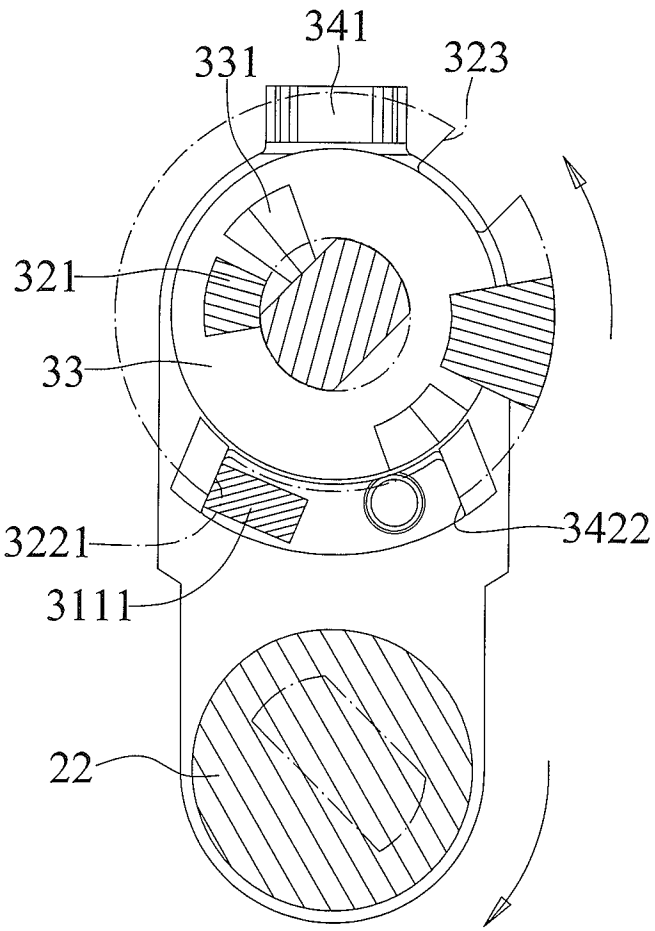
FIG. 5 is an extended cross-sectional view of FIG. 4 and shows each of the first and second hinges rotated through 45 degrees from the position shown in FIG. 4, with the first and second hinges oriented at 90 degrees to each other.
Figure 7:
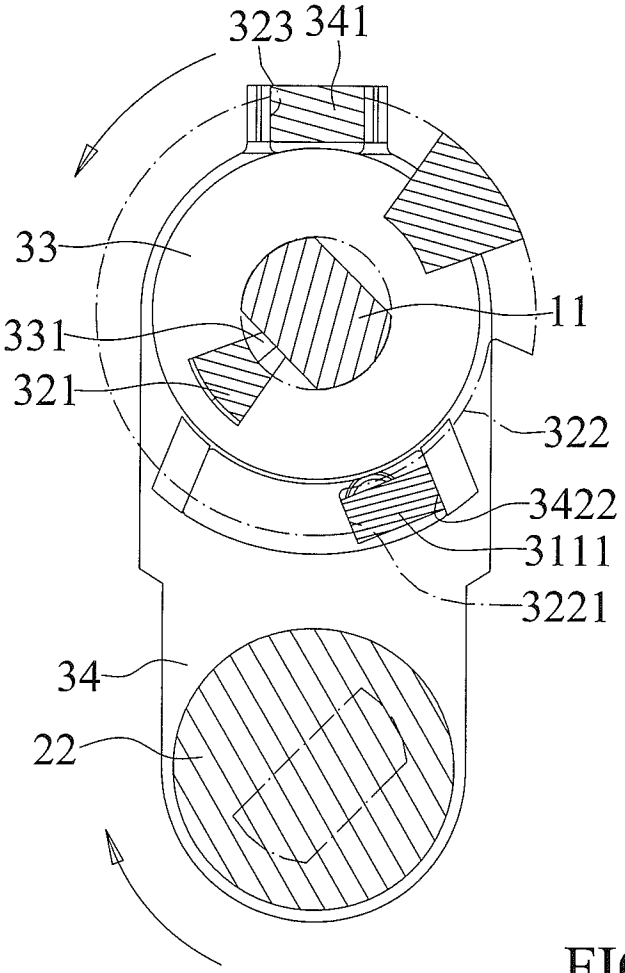
FIG. 7 is an extended cross-sectional view of FIG. 6 and shows each of the first and second hinges rotated through 45 degrees from the position shown in FIG. 6, with the first and second hinges oriented at 270 degrees to each other.
Figure 6:
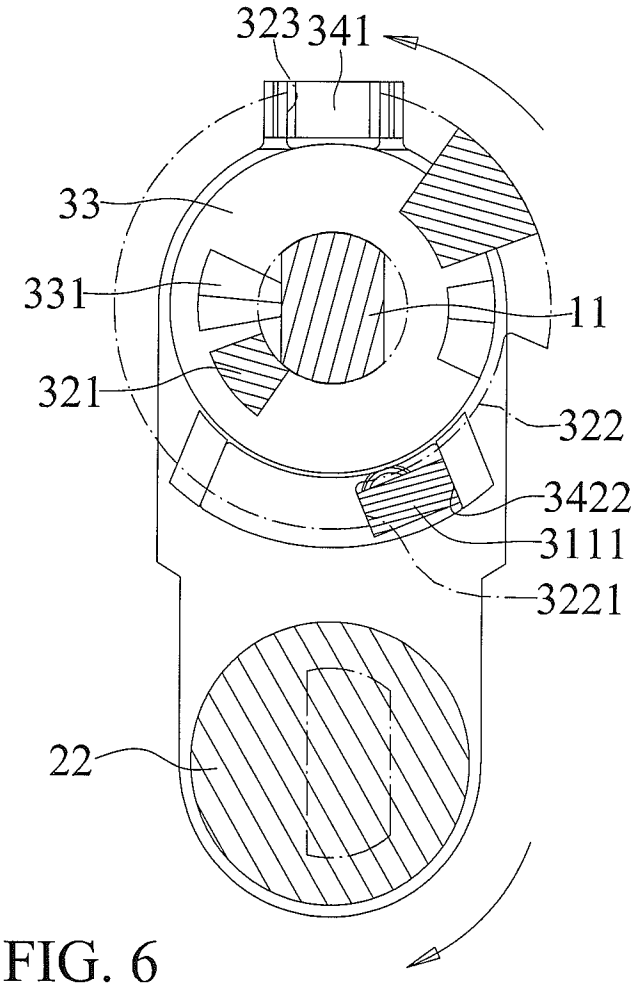
FIG. 6 is an extended cross-sectional view of FIG. 5 and shows each of the first and second hinges rotated through 45 degrees from the position shown in FIG. 5, with the first and second hinges oriented at 180 degrees to each other.
Figure 8:
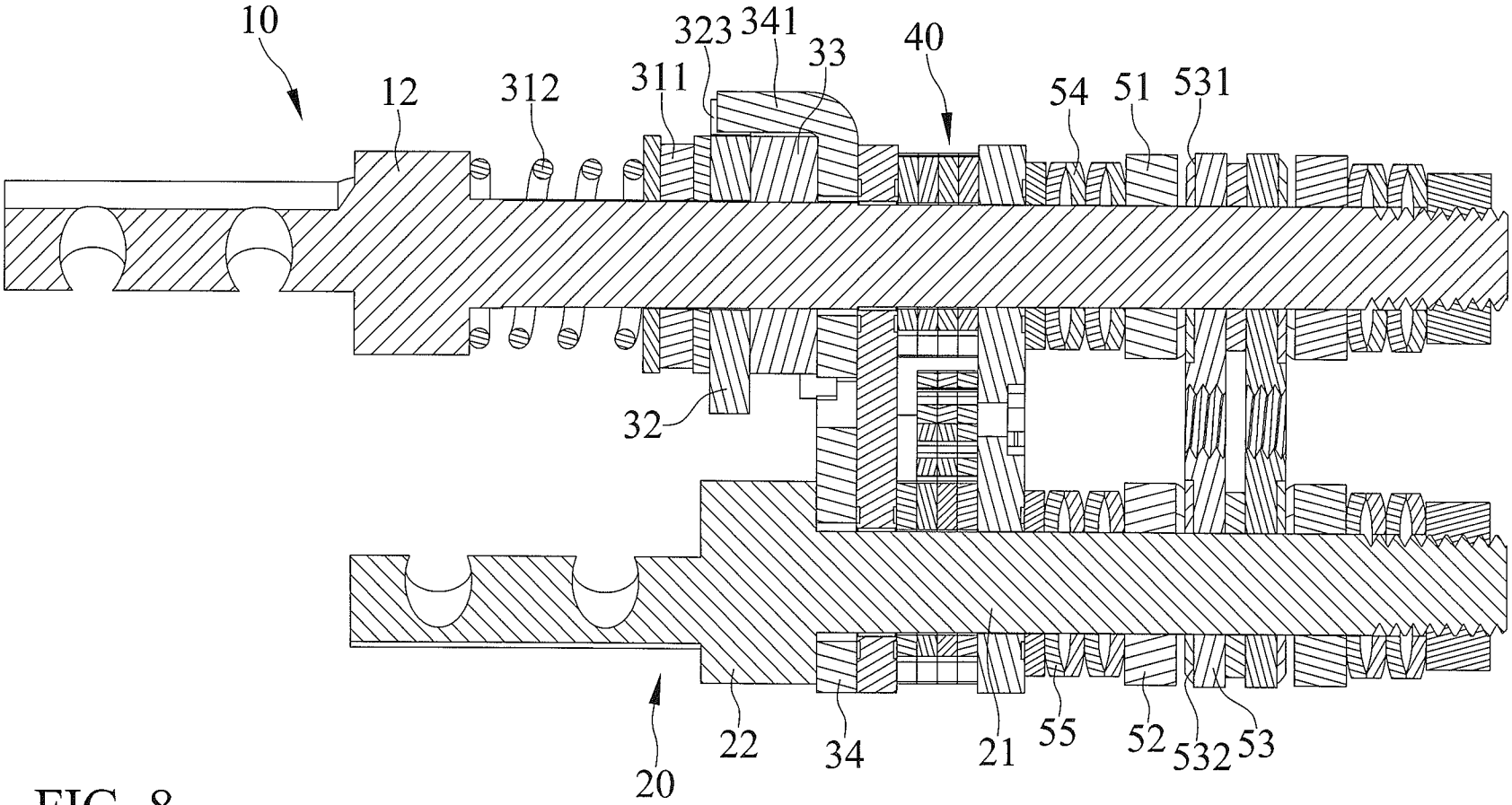
FIG. 8 is another cross-sectional view showing the double-hinge device of the present invention in the position shown in FIG. 7.
Figure 9:
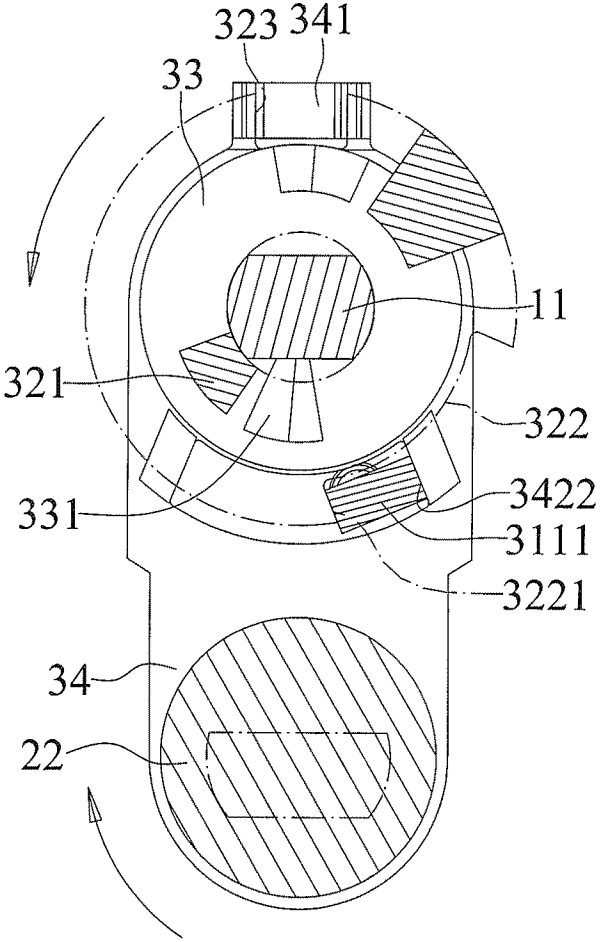
FIG. 9 is an extended cross-sectional view of FIG. 7 and shows each of the first and second hinges rotated through 45 degrees from the position shown in FIG. 7, with the first and second hinges oriented at 360 degrees to each other.

FIGS. 4 through 7 illustrate opening of the double-hinge device. FIG. 4 shows the first hinge 10/first shaft at 0 degrees and the second hinge 20/second shaft at 0 degrees. FIG. 5 shows each of the first and second hinges 10 and 20/each of the first and second shafts rotated through 45 degrees from the position shown in FIG. 4, with the first and second hinges 10 and 20/first and second shafts oriented at 90 degrees to each other. FIG. 6 shows each of the first and second hinges 10 and 20/each of the first and second shafts rotated through 45 degrees from the position shown in FIG. 5, with the first and second hinges 10 and 20/first and second shafts oriented at 180 degrees to each other. FIG. 7 shows each of the first and second hinges 10 and 20/each of the first and second shafts rotated through 45 degrees from the position shown in FIG. 6, with the first and second hinges 10 and 20/first and second shafts oriented at 270 degrees to each other. FIG. 7 also shows the first and second hinges 10 and 20 releasably fixed relative to each other and prevented from being closed. FIG. 9 shows each of the first and second hinges 10 and 20/each of the first and second shafts rotated through 45 degrees from the position shown in FIG. 7, with the first and second hinges 10 and 20/first and second shafts oriented at 360 degrees to each other.

Figure 10:
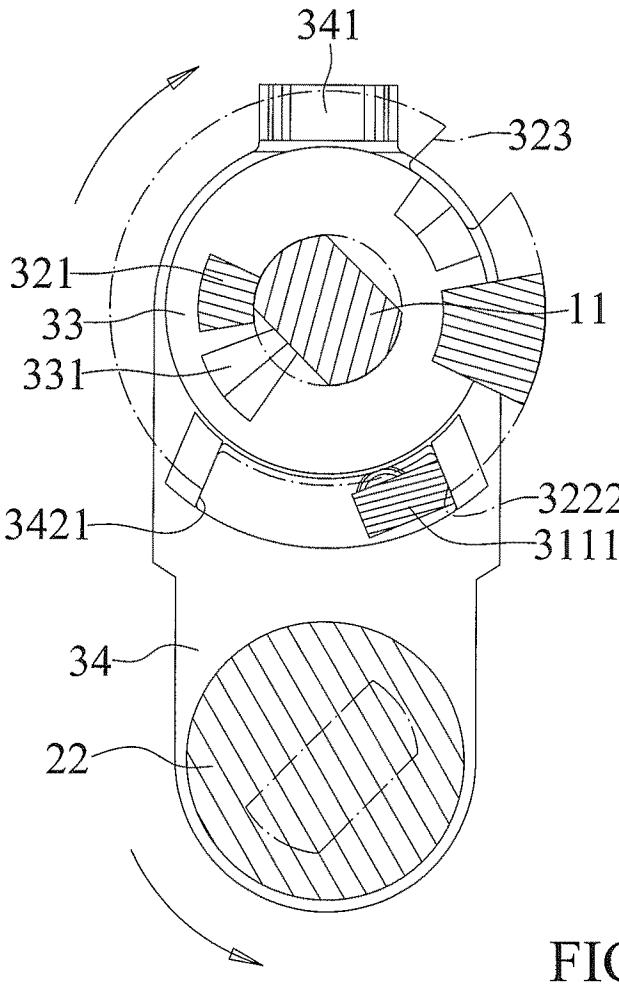
FIG. 10 is an extended cross-sectional view of FIG. 9 and shows each of the first and second hinges rotated through 45 degrees from the position shown in FIG. 9, with the first and second hinges oriented at 270 degrees to each other.
Figure 12:
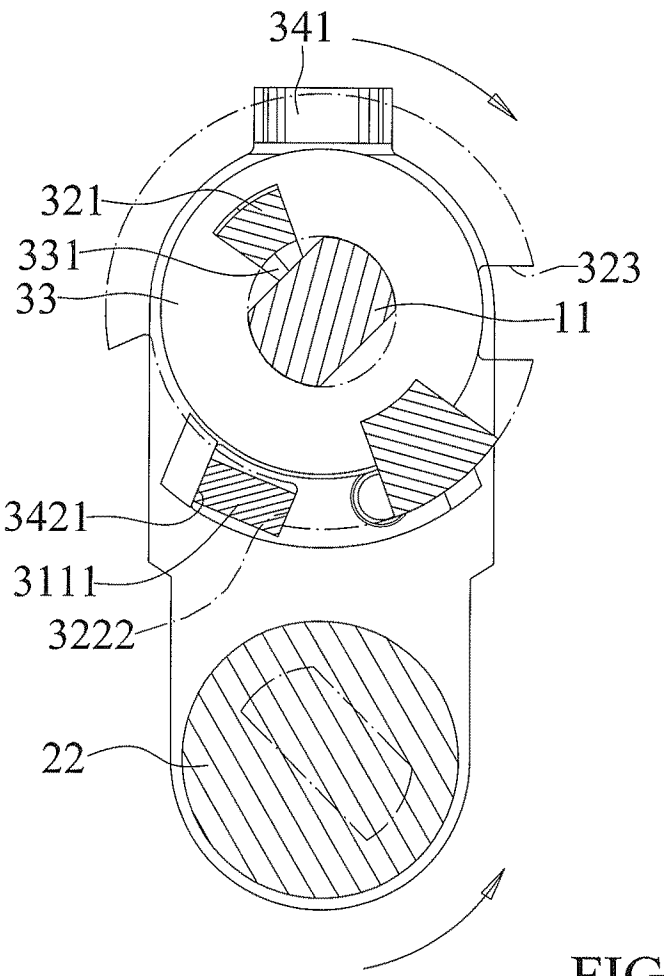
FIG. 12 is an extended cross-sectional view of FIG. 11 and shows each of the first and second hinges rotated through 45 degrees from the position shown in FIG. 10, with the first and second hinges oriented at 90 degrees to each other.
Figure 11:
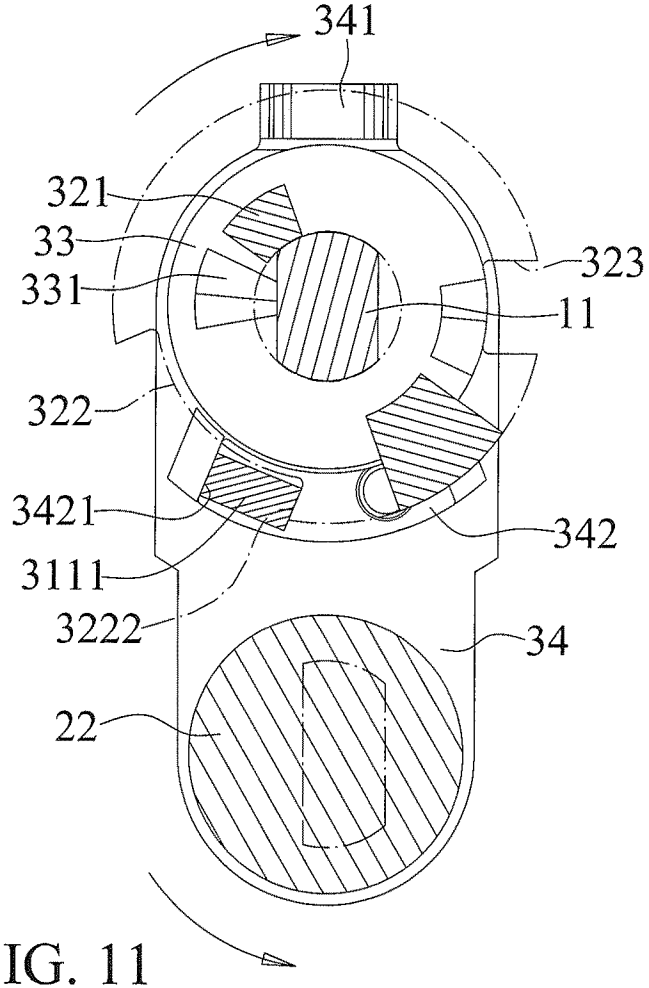
FIG. 11 is an extended cross-sectional view of FIG. 10 and shows each of the first and second hinges rotated through 45 degrees from the position shown in FIG. 10, with the first and second hinges oriented at 180 degrees to each other.

FIGS. 10 through 12 illustrate closing of the double-hinge device. FIG. 10 shows each of the first and second hinges 10 and 20/each of the first and second shafts rotated through 45 degrees from the position shown in FIG. 9, with the first and second hinges 10 and 20/first and second shafts oriented at 270 degrees to each other. FIG. 11 shows each of the first and second hinges 10 and 20/each of the first and second shafts rotated through 45 degrees from the position shown in FIG. 10, with the first and second hinges 10 and 20/first and second shafts oriented at 180 to each other. FIG. 12 shows each of the first and second hinges 10 and 20/each of the first and second shafts rotated through 45 degrees from the position shown in FIG. 10, with the first and second hinges 10 and 20/first and second shafts/first and second shafts oriented at 90 degrees to each other.

The double-hinge device is adapted to be integrated into an electronic device. Preferably, the electronic device includes a first housing and a second housing. The double-hinge device hinge the first and second housings with the first hinge connecting to the first housing and the second hinge connecting to the second housing respectively.

In view of the foregoing, the first and second hinges are adapted to be releasably fixed relative to each other and are prevented from being closed when in a releasably-fixed position.

The foregoing is merely illustrative of the principles of this invention and various modifications can be made by those skilled in the art without departing from the scope and spirit of the invention.

What is claimed is:

1. A double-hinge device comprising:

a first hinge rotatable about a first axis and including a first shaft extending along the first axis;

a second hinge rotatable about a second axis and including a second shaft extending along the second axis; and a first position retainer, a second position retainer, and a third position retainer mounted on the first shaft, wherein the first position retainer includes a first projection, wherein one of the second and third position retainers includes a second projection and another of the second and third position retainers (32, 33) includes a cavity, wherein the second position retainer including a notch, a link plate mounted on the first and second shafts, wherein the link plate includes a second groove, and wherein the second position retainer includes a first groove and the link plate includes a third projection;

wherein the first position retainer is rotatably engaged with the second position retainer and the link plate and includes the first projection engaged in the first and second grooves, wherein the first position retainer is rotatable relative to the second position retainer, wherein the first position retainer is rotatable to a position such that the first projection is restrained by the first groove of the second position retainer and the first and second position retainers are rotatable together, wherein the second position retainer is rotatably engaged with the link plate and the third projection is selectively received by the notch, and wherein the second position retainer is rotatably engaged with the third position retainer and the second projection is selectively received by the cavity; and a drive system interconnecting the first and second shafts such that the rotation of the first and second shafts is synchronized;

wherein the third projection is received by the notch such that the first and second hinges are releasably fixed relative to each other, and wherein the first projection is restrained by the second position retainer and the second projection is received by the cavity when the first and second hinges are releasably fixed relative to each other.

2. The double-hinge device as claimed in claim 1, wherein the third position retainer is located between the second position retainer and the link plate, and wherein the second position retainer is movable along the first shaft in response to relative positions of the second projection and the cavity.

3. The double-hinge device as claimed in claim 1, wherein the drive system includes first gear mounted on the first shaft, a second gear mounted on the second shaft, and two idler gears inserted between the first and second gears, wherein the first and second gears and the two idler gears engage with one another, wherein first of two idler gears is inserted between the first gear and second of the two idler gears, and wherein the second of the two idler gears is inserted between the first of the two idler gears and the second gear.

4. The double-hinge device as claimed in claim 3 further comprising a support mounted on first and second shafts and the two idler gears are mounted on the support.

5. The double-hinge device as claimed in claim 1 further comprising a resilient friction assembly including a first plurality of resilient friction members mounted on the first shaft and a second plurality of resilient friction members mounted on the second shaft respectively.

6. The double-hinge device as claimed in claim 5 further comprising a detent mechanism including a first cam mounted on the first shaft and a second cam mounted on the second shaft respectively, wherein the first and second cams are engaged with a follower, wherein the first plurality of resilient friction members are compressed in response to interaction between the first cam and the follower, and wherein the second plurality of resilient friction members are compressed in response to interaction between the second cam and the follower.

7. The double-hinge device as claimed in claim 6, wherein the follower is mounted on the first and second shafts.

8. The double-hinge device as claimed in claim 1 further comprising a biasing member mounted on the first shaft, wherein the first, second, and third position retainers and the link plate are disposed on a same side of the biasing member, and wherein an end of the biasing member is restrained by the first shaft.

9. The double-hinge device as claimed in claim 8, wherein the biasing member is a spring with a plurality of coils.

10. The double-hinge device as claimed in claim 1, wherein the first hinge is rotatable through 180 degrees, and wherein the second hinge is rotatable through 180 degrees.

11. The double-hinge device as claimed in claim 1, wherein the first shaft is rotatable through 180 degrees, and wherein the second shaft is rotatable through 180 degrees.

12. The double-hinge device as claimed in claim 1, wherein the first and second hinges are oriented at an angle to each other, wherein the angle is increased in response to opening the double-hinge device, and wherein the angle is decreased in response to closing the double-hinge device.

13. The double-hinge device as claimed in claim 1, wherein the first and second shafts are oriented at an angle to each other, wherein the angle is increased in response to opening the double-hinge device, and wherein the angle is decreased in response to closing the double-hinge device.

14. The double-hinge device as claimed in claim 12, wherein the first and second hinges are prevented from rotating to close the double-hinge device when the first and second hinges are releasably fixed relative to each other.

* * * * *